US007874114B2

(12) United States Patent
Snyder

(10) Patent No.: US 7,874,114 B2
(45) Date of Patent: Jan. 25, 2011

(54) RADIANT HEAT BARRIER

(75) Inventor: Darryl L. Snyder, Sarasota, FL (US)

(73) Assignee: Snyder National Corporation, Canton, OH (US)

( * ) Notice: Subject to any disclaimer, the term of this patent is extended or adjusted under 35 U.S.C. 154(b) by 106 days.

(21) Appl. No.: 11/875,649

(22) Filed: Oct. 19, 2007

(65) Prior Publication Data

US 2008/0134608 A1 Jun. 12, 2008

Related U.S. Application Data

(60) Provisional application No. 60/853,237, filed on Oct. 20, 2006, provisional application No. 60/873,754, filed on Dec. 8, 2006.

(51) Int. Cl.
*E04B 1/78* (2006.01)

(52) U.S. Cl. ..... 52/407.3; 52/95; 52/407.5

(58) Field of Classification Search ..... 52/95, 52/302.1, 407.3, 407.4, 407.5; 108/51.3; 229/172, 913; 206/784
See application file for complete search history.

(56) References Cited

U.S. PATENT DOCUMENTS 1,811,135 A * 6/1931 Knowlton ..... 229/182
1,894,592 A * 1/1933 Kilmer ..... 52/407.3
2,101,836 A 12/1937 Benedict
2,135,021 A * 11/1938 Zalkind ..... 229/117.12
2,221,309 A 11/1940 Gazelle
2,227,479 A * 1/1941 Zalkind ..... 229/117.12
2,238,022 A * 4/1941 Johnson ..... 52/404.3
2,246,198 A * 6/1941 Zalkind ..... 229/181
2,256,834 A * 9/1941 Mandel ..... 229/125.39
2,283,257 A * 5/1942 Jorsch ..... 52/406.1
2,788,552 A * 4/1957 Miles ..... 52/407.3
2,960,149 A * 11/1960 Throssel ..... 297/440.12
3,337,113 A * 8/1967 Harrison ..... 206/303
3,449,157 A 6/1969 Wandel
3,731,449 A 5/1973 Kephart
3,803,784 A 4/1974 Becker
4,070,839 A 1/1978 Clem
4,125,982 A 11/1978 Ward
4,185,433 A * 1/1980 Cantrell ..... 52/94
4,292,777 A 10/1981 Story
4,378,743 A * 4/1983 McFarland ..... 108/51.3
4,557,092 A 12/1985 Brueske (Continued)

FOREIGN PATENT DOCUMENTS

CA 2266043 * 9/2000

(Continued)

*Primary Examiner*—Robert J Canfield
(74) *Attorney, Agent, or Firm*—Zollinger & Burleson Ltd

(57) ABSTRACT

A radiant heat barrier may be installed under a wide variety of roofs between the roof supports. In one configuration, the radiant heat barrier is provided in the form of a plurality of boards that are each erectable into a barrier tray having at least one high-reflectivity, low-emissivity surface. The surface reflects a large percentage of the radiation energy back in the direction from where the radiation originated. Each board includes features that allow the board to be formed into different-sized trays. In one configuration, the trays may be configured to fit between the rafters of typical residential construction. The trays include tabs that allow the tray to be mounted to the supports.

15 Claims, 8 Drawing Sheets

U.S. PATENT DOCUMENTS 4,704,837 A 11/1987 Menchetti et al.
4,726,985 A 2/1988 Fay
4,776,142 A 10/1988 Hardesty
4,960,238 A * 10/1990 Lorenz ..... 229/125.29
5,000,372 A * 3/1991 Hollander et al. ..... 229/103.11
5,176,090 A * 1/1993 Roberts et al. ..... 108/51.3
5,339,577 A 8/1994 Snyder
5,491,952 A 2/1996 Alderman
5,799,461 A 9/1998 Dittemore
5,918,436 A 7/1999 Alderman
6,112,490 A 9/2000 Meyer
6,346,040 B1 * 2/2002 Best ..... 454/260
6,557,313 B1 5/2003 Alderman
6,694,693 B2 * 2/2004 Alderman ..... 52/478
6,754,995 B1 * 6/2004 Davis et al. ..... 52/95
6,857,238 B2 2/2005 Alderman
6,925,765 B2 8/2005 Fay
6,959,813 B2 * 11/2005 Colby ..... 206/526
7,000,549 B2 * 2/2006 Nelson ..... 108/51.3
7,017,315 B2 * 3/2006 Corwin ..... 52/407.3
7,024,832 B2 4/2006 Matumoto
2001/0029718 A1 10/2001 Snyder
2003/0167719 A1 * 9/2003 Alderman ..... 52/407.3
2003/0192278 A1 10/2003 Snyder
2005/0160684 A1 * 7/2005 Duncan ..... 52/95

FOREIGN PATENT DOCUMENTS

GB 2125081 A * 2/1984

* cited by examiner

RADIANT HEAT BARRIER

CROSS REFERENCE TO RELATED APPLICATIONS

This application claims the benefit of U.S. Provisional Patent Application Ser. No. 60/853,237, filed Oct. 20, 2006, and claims the benefit of U.S. Provisional Patent Application Ser. No. 60/873,754, filed Dec. 8, 2006; the disclosures of both are incorporated herein by reference.

BACKGROUND OF THE INVENTION

1. Technical Field

The present invention generally relates to insulation for buildings and, more particularly, to insulation members designed to reflect radiant heat energy. The radiant barrier may be used with or without traditional bulk insulation. The insulation members are provided in the form of corrugated boards having at least one reflective surface. The boards may be formed into five-sided trays that limit air flow and reflect radiant energy or may be formed into channels that fit over bulk insulation.

2. Background Information

A variety of building, both commercial and residential, would benefit from a radiant heat barrier disposed at the ceiling to reflect radiation energy. Such a radiant heat barrier will reduce energy costs. Most of these buildings have metal or wood ceiling supports. In wood frame construction, angled wood ceiling supports are called rafters while horizontal supports may be called joists. In other type of construction, the roof may be supported between trusses, beams, or a combination of all of these supports. Most wood-framed residential buildings constructed in the past few decades were constructed with insulated attics having rafters and joists spaced on standard centerlines. The insulation is typically disposed between the floor joists in the form of loose blown insulation or batts of rolled insulation. Although this insulation is effective to container heat transfer by conduction and convection, it does little to prevent heat transfer due to radiation. As energy prices rise, owners of such buildings desire an insulation member that may be used to reduce heat transfer attributable to radiation. Such members should be easy to install in existing construction.

BRIEF SUMMARY OF THE INVENTION

The invention provides a radiant heat barrier that may be installed under a wide variety of roofs between the roof supports. In one configuration, the radiant heat barrier is provided in the form of a plurality of boards that are each erectable into a barrier tray having at least one high-reflectivity, low-emissivity surface. The surface reflects a large percentage of the radiation energy back in the direction from where the radiation originated. Each board includes features that allow the board to be formed into different-sized trays. In one configuration, the trays may be configured to fit between the rafters of typical residential construction.

In one configuration, the invention provides a board having at least one high-reflectivity, low-emissivity surface. The board may be erected into one or two trays. Each tray includes connection tabs that are movable with respect to the tray into different positions. Each connection tab may be moved 180 degrees with respect to the side of the tray. The tab is used to secure the tray to the rafter. The trays have end walls so that the trays trap air between the rafters. The trays may be configured to fit between rafters disposed on 24 inch centerlines.

Another configuration of the invention is the method of erecting and installing the trays wherein the method includes the steps of providing the boards having at least one high-reflectivity, low-emissivity surface, erecting a plurality of five-sided trays, and installing the five-sided trays in an end-to-end configuration to define a radiant heat barrier between rafters.

Another configuration of the invention provides a roof configuration for a building wherein the roof configuration includes a roof board and a pair of spaced supports with a plurality of five-sided trays disposed between the supports. Each of the trays has at least one high-reflectivity, low-emissivity surface to reflect radiant heat energy. The side and end walls of the tray abut the inner surface of the roof and the trays are disposed end-to-end to limit air flow between the rafters. Connection tabs folded outwardly from the sides of the trays are used to secure the trays in place.

In another configuration, the invention provides a radiant energy insulation system that is used in combination with traditional bulk insulation. The insulation system includes insulation boards that are folded to form an inverted channel that is fit loosely over a section of bulk insulation between a pair of attic floor joists. The inverted channel is sized to define an air gap between the top of the bulk insulation and the inner surface of the upper cross member of the channel. At least one surface of the channel has high reflectivity and corresponding low emissivity to provide a barrier to thermal radiation. In one configuration, the invention provides a channel with two high-reflectivity, low-emissivity surfaces to provide dual benefits. A plurality of these channels defines one configuration of the system of the invention. These channels may be used alone or in combination with the high-reflectivity, low-emissivity trays secured to the rafters described above.

An optional system configuration provides a plurality of inverted channels and a catwalk for use by the person installing the channels. The system allows the channels to be installed in existing construction by providing a support for the worker who is fitting the channels between existing joists. The catwalk includes a plurality of risers that support platforms above the channels.

Another aspect of the invention is the use of high reflectivity boards to form continuous insulating channels in the rafters opposite the lower channels at the floor joists. In one embodiment of the invention, the boards used to form the upper channels include tabs that may be folded into different configurations for connecting the boards to the rafters. These tabs allow the boards to be desirably positioned with respect to the inner surface of the roof.

In one embodiment, the invention provides a system having a plurality of clips that connect the channels in an end-to-end configuration so that the air space is continuous.

The invention also provides an insulation kit including a plurality of channel boards, a plurality of risers, and a plurality of platforms.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
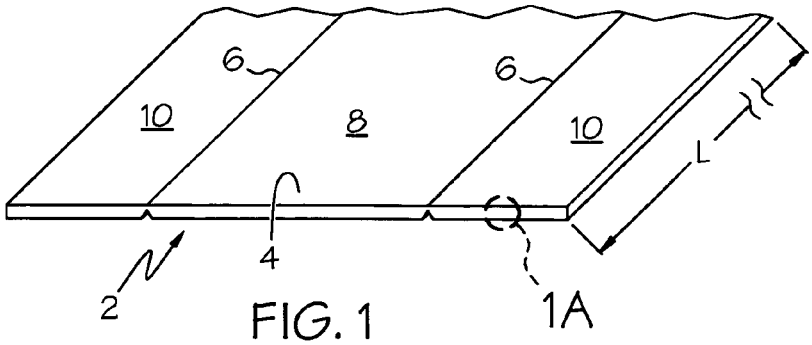
FIG. 1 is a perspective view of a board used to form an insulating channel.

A channel board is indicated generally by the numeral 2 in FIG. 1. Board 2 includes a corrugated central layer sandwiched between a pair of liner boards. At least one of the liner boards has an outwardly-disposed, high-reflectivity, low-emissivity surface 4. Such a surface may be formed by laminating a thin layer of metal such as aluminum to a liner board. The surface may also be formed by coating the liner board with a high-reflectivity, low-emissivity material such as an appropriate paint or by metallizing the liner board. Both outer surfaces of board 2 may be high-reflectivity, low-emissivity. Board 2 may be treated to be fire resistant or fire proof. An example of a board structure that may be used as channel board 2 is disclosed in U.S. Pat. No. 5,339,577; the disclosure of which are incorporated herein by reference. In some applications, board 2 may be perforated to allow moisture to pass through board 2 so that such moisture is not trapped in the building.

Channel board 2 may include a pair of parallel, spaced apart score or indented fold lines 6 that define an upper cross member 8 between the score lines 6 with legs 10 disposed outwardly of score lines 6. Score lines 6 allow legs 10 to be folded down with respect to cross member 8 without the use of tools or straight edges. In one configuration, score lines 6 are spaced apart 22½ inches so that cross member 8 will snugly fit between 2×4 joists 12 spaced 24 inches on center. When a looser fit is desired, score lines may be spaced apart from 22½ inches to 21 inches to allow legs 10 to fit between joists 12 while still being far enough apart to cover the bulk insulation 14 disposed between joists 12. Legs 10 may be provided in a variety of heights to fit over different types of insulation. In one configuration, legs are 10-18 inches tall in order to locate cross member 8 well above insulation 14 to define an air gap 16. If insulation 14 is no higher than joists 12, then legs 10 are to be formed to be about four inches taller than joists 12 so that a four inch air gap is defined above insulation 14. Board 2 may be provided in a variety of lengths. A four foot length is desirable because many structures are built on four foot intervals and because a four foot length allows channel boards 2 to fit through attic trap door access panels.

Board 2 is used to form an insulating channel 20 by folding down both legs 10 in the same direction to form a U-shaped channel that is slipped down between a pair of adjacent joists 12 over any insulation 14 disposed between joists 12. Legs 10 are tall enough to position cross member 8 above the top of insulation 14 to define air gap 16. Gap 16 may be at least 4 inches tall. One to four inch air gaps 16 have been tested under the ASTM STP 1116 test procedure. The four inch air gap 16 yielded the highest thermal resistance in both the summer and winter testing configurations. The four inch gap 16 summer condition (heat flow down) test yielded an R-value of 7.57 at a temperature differential of 115 to 85 degrees Fahrenheit and an R-value of 8.02 at a temperature differential of 90 to 60 degrees Fahrenheit. These R-values were approximately double the measured R-value of a one inch gap 16. The four inch gap 16 winter condition (heat flow up) test yielded an R-value of 2.05 at a temperature differential of 65 to 35 degrees Fahrenheit and an R-value of 2.06 at a temperature differential of 90 to 60 degrees Fahrenheit.

Channels 20 are installed end-to-end and may be taped together. A clip 22 such as the one shown in cross section in FIG. 3A also may be used to hold the ends together. If there is only a single reflective surface 4, channels 20 are installed with reflective surface 4 facing up toward the roof of the building. Channels 20 increase the insulating factor by reflecting thermal radiation coming down from the roof of the building and preventing it from reaching the insulation 14 or the ceiling panels 24. When channels 20 have two reflective surfaces, the downwardly facing surface reflects heat back into insulation 14. Legs 10 also reflect the heat from different angles providing a multiple dimension insulator for between the joists 12.

A catwalk system 50 is also provided to help the person installing channels 20. Such installation may be difficult when there is no floor to support a worker in attics where channels 20 may be installed. Such attics may have limited access openings which make it difficult to take long supports up into the space along with channels 20. Further, the cross members 8 of channels 20 are disposed well above joists 12 making it difficult for a worker to rest supports directly on joists 12 as shown in FIG. 4 (FIG. 3 showing an embodiment wherein the bulk insulation is higher than joists 12).

Figure 2:
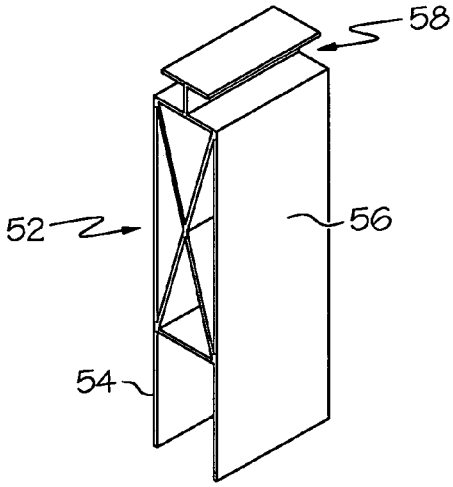
FIG. 2 is a perspective view of a single riser for a catwalk used to install the insulating channels.
Figure 2A:
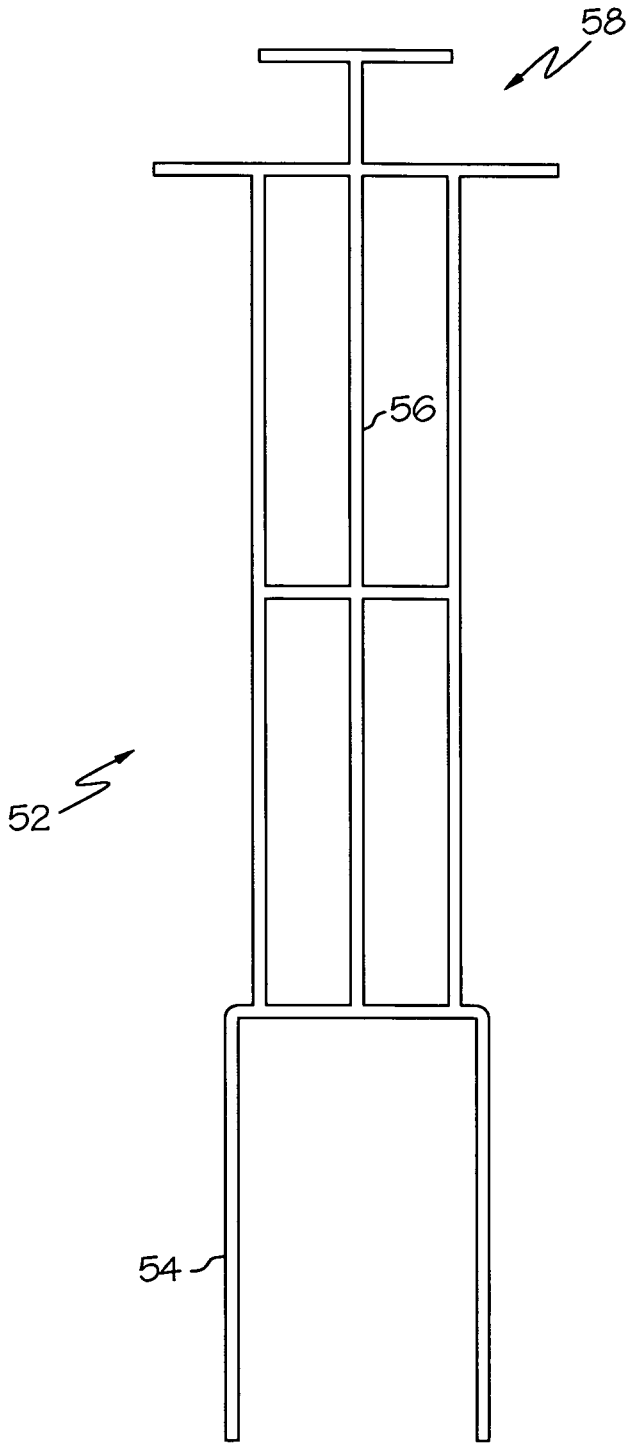
FIG. 2A is an end view of another catwalk riser.

System 50 includes a plurality of risers 52 and at least one platform 53 supported by a pair of risers 52. A riser 52 may be connected to each joist 12 or every other joist 12 with platforms 53 being appropriately sized to fit between risers 52. If joists are 24 inches on center, then each platform 53 is slightly less than 24 inches long. Each riser 52 includes a U-shaped foot 54 adapted to slide over a typical joist 12. Foot 54 may be secured to joist 12 with an adhesive or a mechanical fastener. An extension section 56 is disposed above foot 54. Section 56 may be provided in the form of a box with a reinforcement web such as the "×" and "+" patterns depicted in the drawings. At least one C-shaped holder 58 is disposed on the top of extension section 56. Holders 58 are disposed back-to-back to receive two platform ends as shown in FIG. 4. Foot 54 has a height smaller than the height of joist 12 so that the bottom of riser 52 will not contact ceiling panels 24. Extension section 56 is tall enough to locate holder 58 above channels 20. Different heights of section 56 are depicted in FIG. 2A. Each holder 58 is sized to receive the end of platform 53. Platforms 53 may be 12 inches to sixteen inches wide with risers 52 being less wide so that platforms 53 are wider than risers 52.

Figure 3:
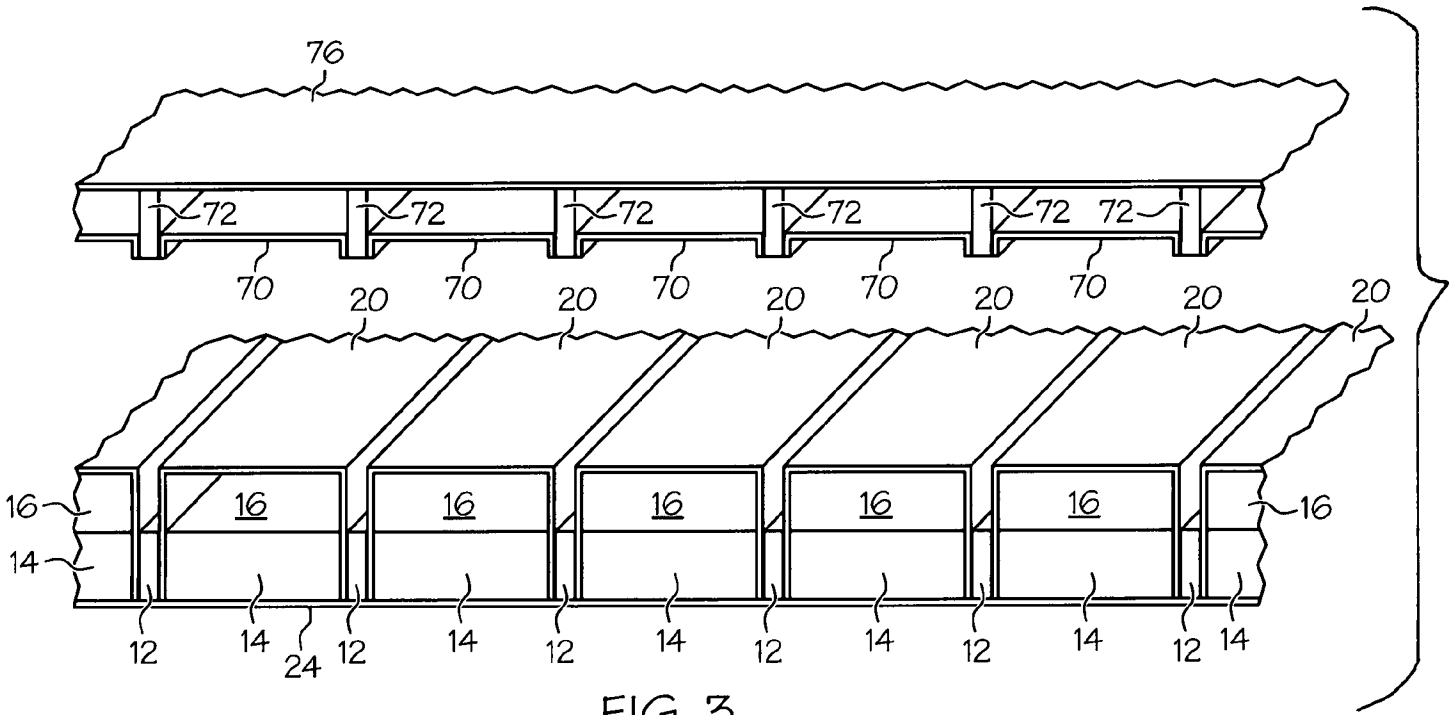
FIG. 3 is a schematic section view showing a series of insulating channels installed between the joists and rafters.
Figure 3B:
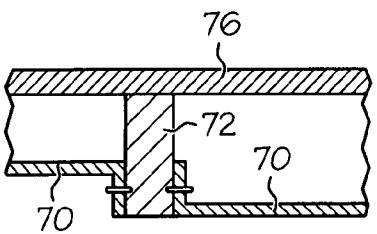
FIG. 3B is a section view showing alternative configurations for the connection of the board with the rafter.
Figure 3A:
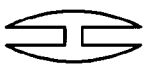
FIG. 3A is an end view of an exemplary clip.
Figure 4:
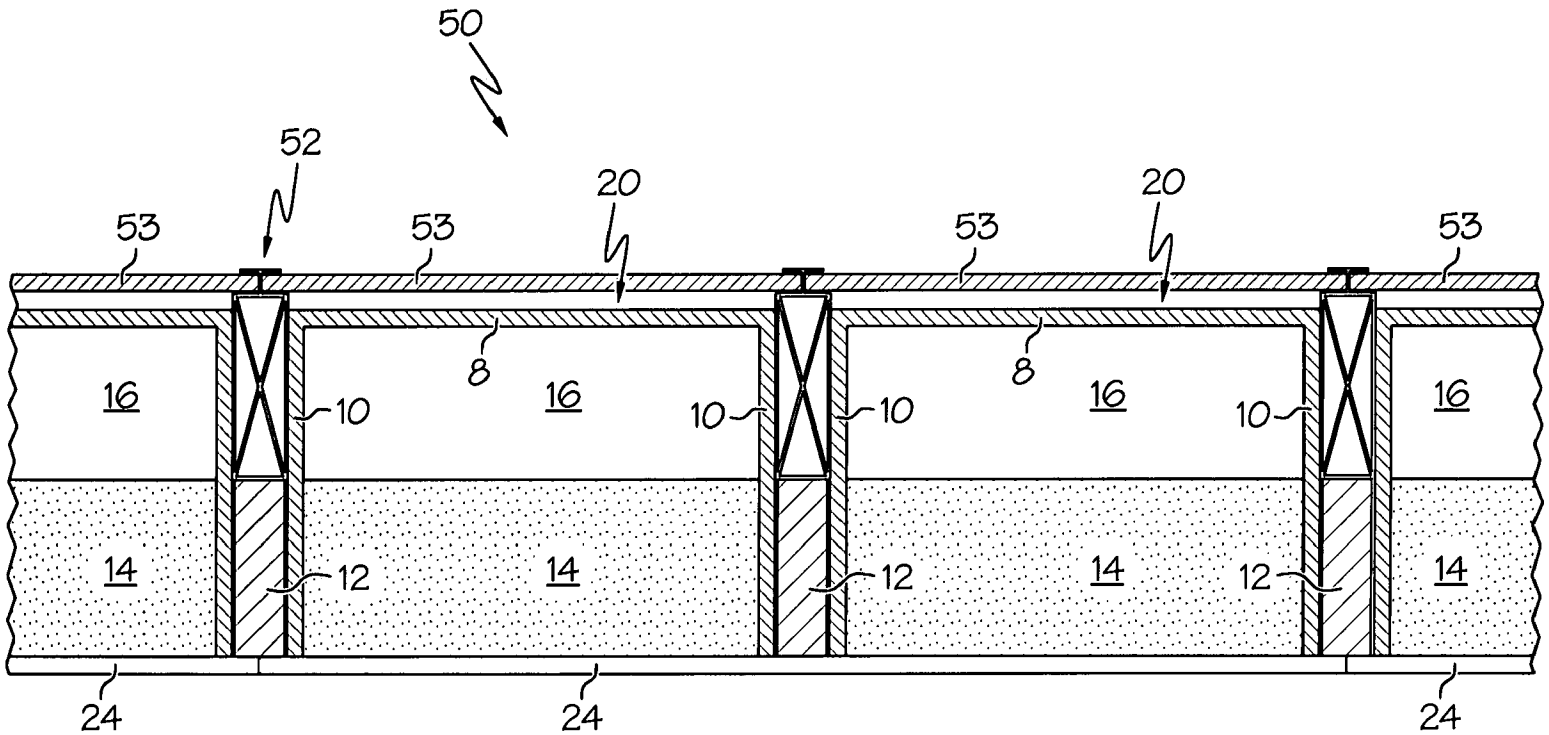
FIG. 4 is an enlarged section view of the channels formed between the joists.
Figure 5A:
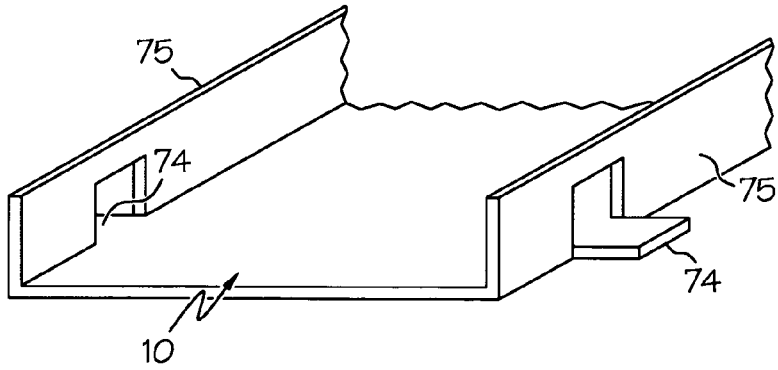
FIG. 5A is a perspective view of a board used to form the channels between the rafters with its connection tab disposed in a first position.

FIG. 3 shows an installation configuration wherein channels 20 are combined with high-reflectivity low-emissivity boards 70 secured to the rafters 72. Boards 70 may have the construction depicted in U.S. Pat. No. 5,339,577. This configuration adds another reflective layer to the system that is particularly useful in the summer when the sun heats the roofing material. Boards 70 may be formed with the attachment tabs 74 depicted in FIGS. 5A and 5B. Tabs 74 have crenulated sidewalls for safety. Tabs 74 may be used in three configurations. The first configuration is where tab 74 is disposed parallel to the sidewall 75 the board 70. The second configuration (FIG. 5A) is where tab 74 is disposed parallel to the bottom of board 70 and may be attached to the bottom edge of rafter 72. The third configuration (FIG. 5B) is where tab 74 is disposed parallel to the side of board 70 and is bent down away from the side of board 70 so that board 70 may be easily connected to rafters 72 at a desirable spacing from the inner surface of roofing material 76 Tabs 74 may be disposed in pairs along the length of board 70.

Figure 1A:
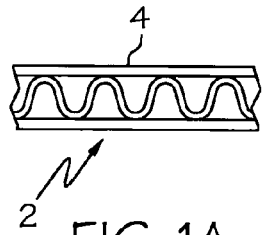
FIG. 1A is an enlarged view of the encircled portion of FIG. 1.
Figure 6:
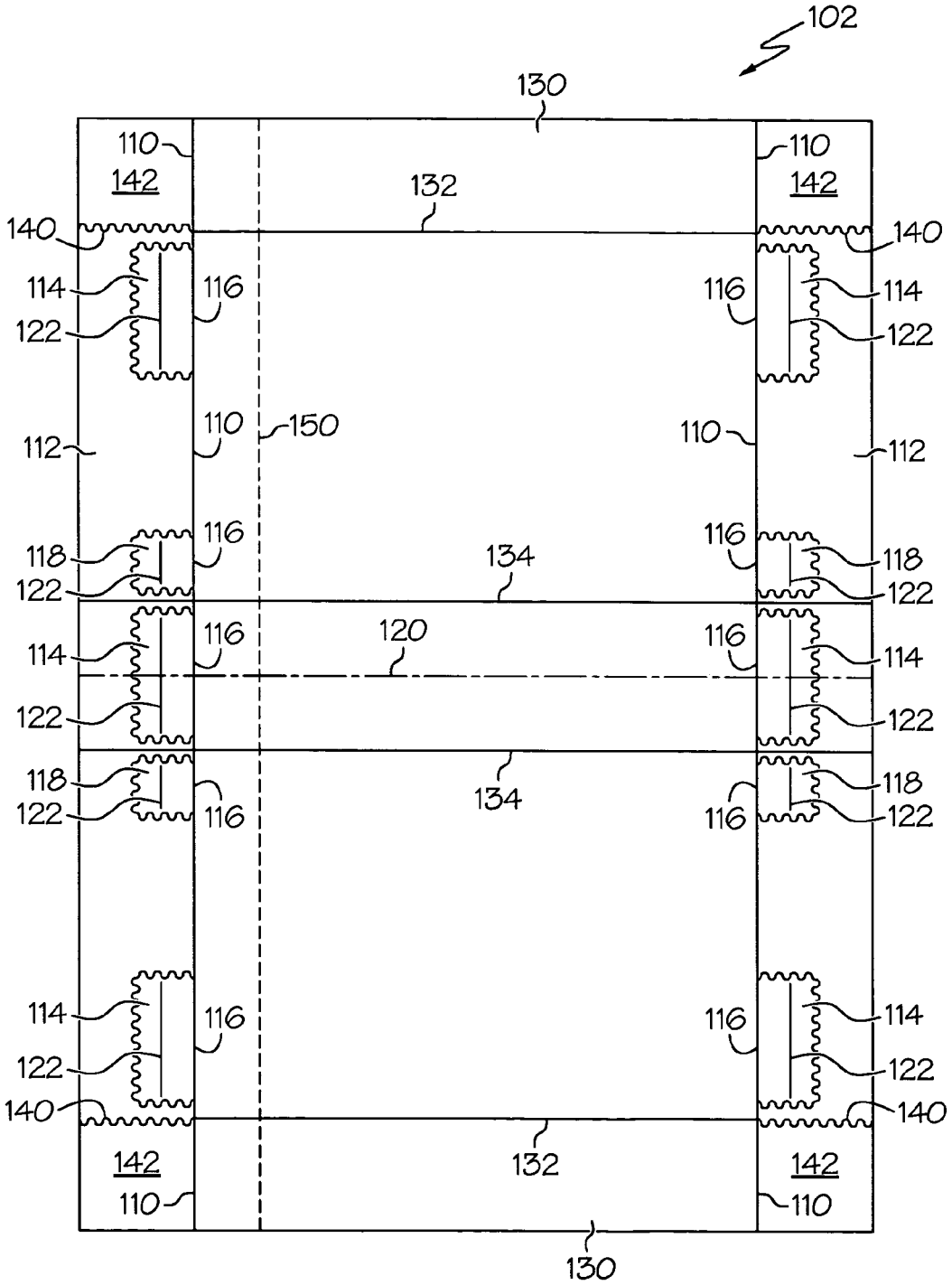
FIG. 6 is a top plan view of a radiant heat barrier board before it is configured to be installed between rafters.

A exemplary configuration of a radiant heat barrier board 102 used to erect one of two radiant heat barrier trays 104 is depicted in FIG. 6. Board 102 includes a corrugated central layer sandwiched between a pair of liner boards similar to board 2 described above and shown in FIGS. 1 and 1A. At least one of the liner boards has an outwardly-disposed, high-reflectivity, low-emissivity surface. Such a surface may be formed by laminating a thin layer of metal such as aluminum to a liner board. The surface may also be formed by coating the liner board with a high-reflectivity, low-emissivity material such as an appropriate paint or by metallizing the liner board. Both outer surfaces 104 of board 102 may be high-reflectivity, low-emissivity. Board 102 may be treated to be fire resistant or fire proof. An example of a board structure that may be used as channel board 102 is disclosed in U.S. Pat. No. 5,339,577, which has been incorporated herein by reference. In some applications, board 102 may be perforated to allow moisture to pass through board 102 so that such moisture is not trapped in the building.

Figure 7:
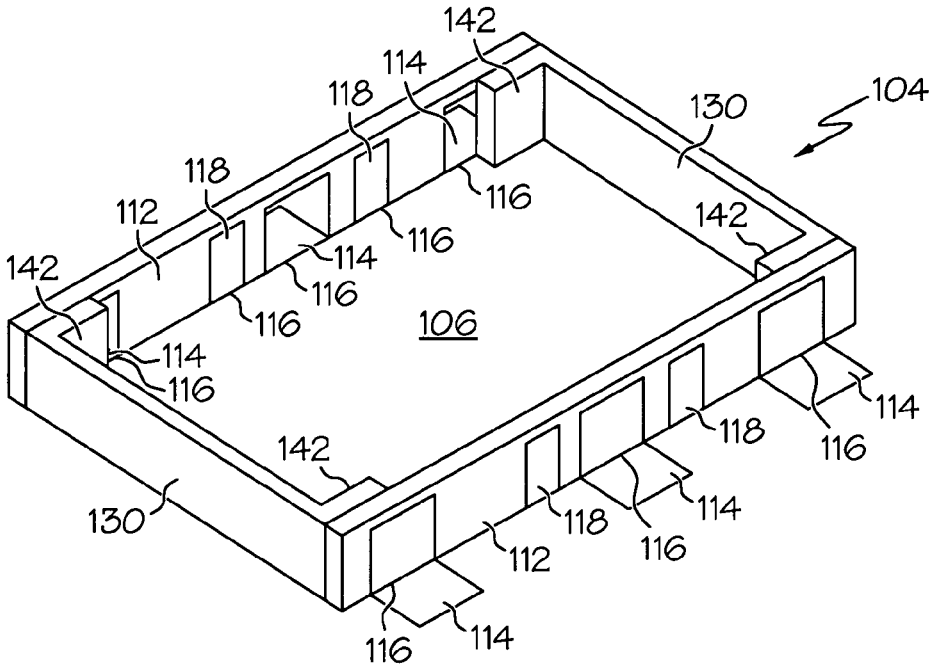
FIG. 7 is a perspective view of a tray erected from the board of FIG. 6.
Figure 8:
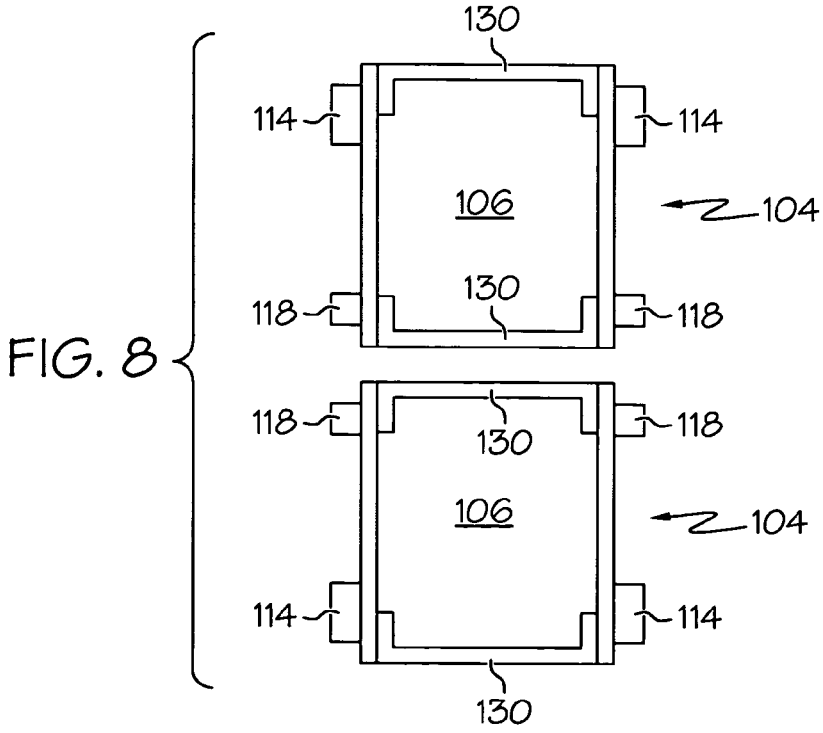
FIG. 8 is a top plan view of two trays erected from the board of FIG. 6.
Figure 9:
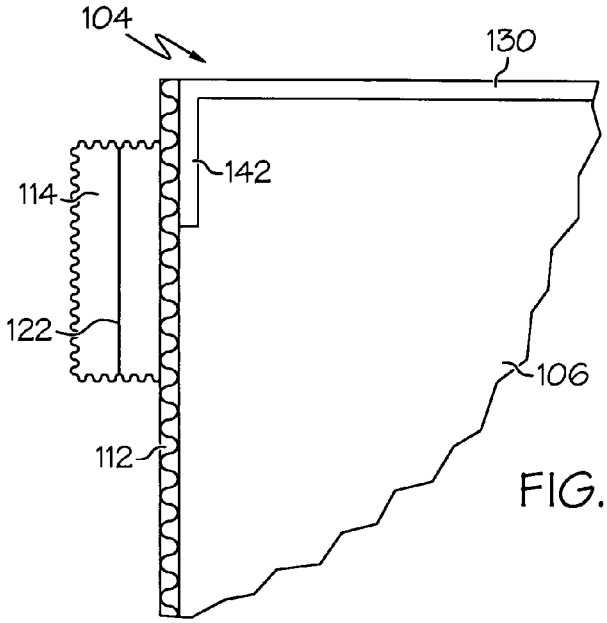
FIG. 9 is a top plan view of one of the corners of a radiant heat barrier tray formed from the board of FIG. 6.

Board 102 is configured to be erected into a long tray 104 or a pair of short trays 104 as shown in FIGS. 7 and 8. In this application, a fold line is a marking disposed on board 102 indicated the location where a fold should be made. A score line is an indentation or a series of indentations that allow a fold to be readily made. A cut line is an area that has already been sliced or cut. A perforated line is a line made up of a plurality of small cut lines. Referring to FIG. 6, board 102 includes a body 106 disposed between a pair of longitudinal fold or score lines 110 spaced inwardly from its lengthwise sides. Body 106 includes an inner surface (designed to face the roof) and an outer surface. At least one, but optionally both of these sides, has the high-reflectivity, low-emissivity property desired in a radiant heat barrier. Lines 110 are disposed 3 to 4 inches from the outer edges with a distance of 3.5 inches being exemplary. Lines 110 allow the longitudinal edges 112 of board 102 to be folded up to define the sides 112 of tray 104.

Figure 5B:
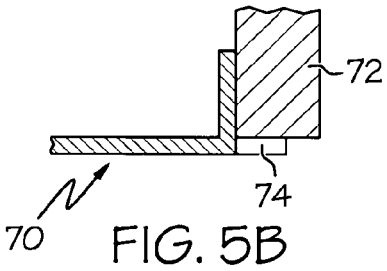
FIG. 5B is a section view showing the connection tab under the rafter.
Figure 5C:
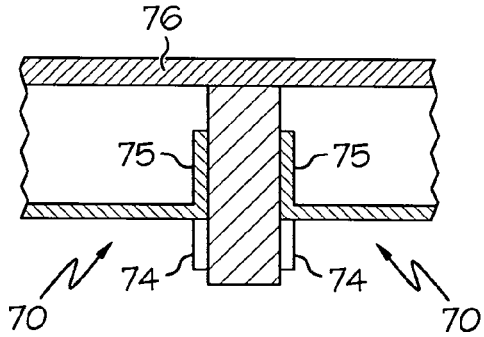
FIG. 5C is a section view of the rafter board with its connection tab disposed in a second position.
Figure 5D:
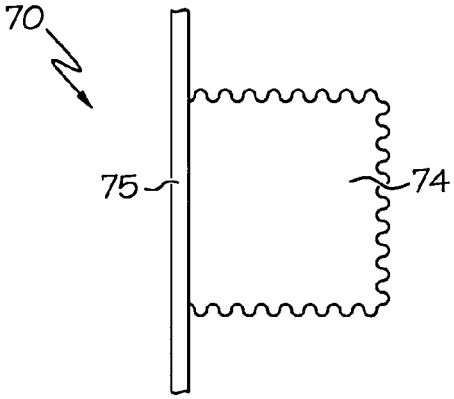
FIG. 5D is an enlarged top plan view of a connection tab showing the crenulated edges of the tab.

Each side 112 includes at least two primary connection tabs 114. In the exemplary embodiment of the invention, three tabs 114 are disposed in each side 112. Each tab 114 is defined by a cut or perforated line so that tab 114 may move independent of side 112 on a living hinge 116. Each tab 114 may be movable between at least three positions with a first position being disposed zero degrees to side 112 (such as tabs 118 in FIG. 7), a second position being 90 degrees to side 112 (such as tabs 114 in FIG. 7), and a third position being 180 degrees to side 112 (such as tab 74 in FIG. 5C). As described above, the cut or perforation that defines each tab 114 may be crenulated to minimize sharp edges that can cut. In one exemplary configuration, a secondary connection tab 118 is disposed on each side of the central connection tab 114. Connection tabs 118 are used when board 102 is separated along an optional separation line 120 (may be perforated, scored, or marked) and erected into a pair of trays 104 as shown in FIG. 8. Each tab 114 and 118 may be positioned under a rafter (similar to what is shown in FIG. 5B) or against the side surface of the rafter (similar to what is shown in FIG. 5C). A score line 122 runs through the length of each tab 114 and 118 to allow the user to bend tab 114 or 118 around two sides of a thin support member such as a metal support or a thin rafter.

The end walls 130 of tray 104 are formed by folding up the ends 130 of board 102 along lines 132. When two trays are erected, fold lines 134 (may be marked or scored) are used to form end walls 130. Lines 132 are marked or scored between lines 110 but are perforated or cut outwardly of line 110 as indicated by reference numeral 140. Lines 140 are crenulated to avoid sharp edges. The corners 142 are folded inwardly and are secured to the inner surfaces of sides 112 with adhesive, tape, or mechanical connectors such as staples.

Board 102 includes a line 150 that allows the user to form a thinner tray 104 by removing the side disposed outwardly of line 150 and forming a new side 112 as needed.

Figure 10:
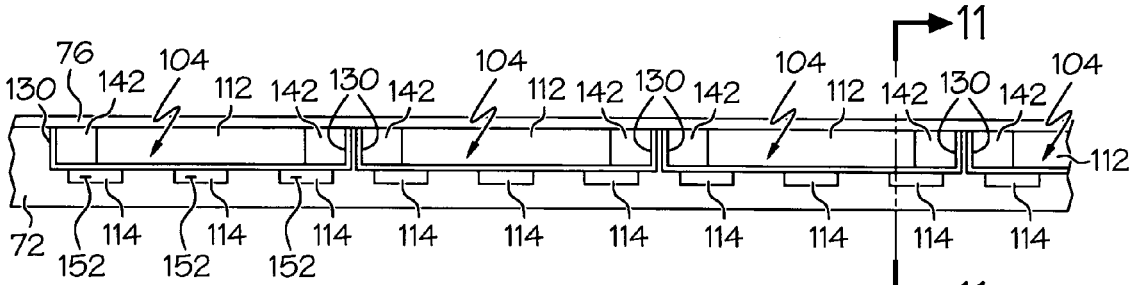
FIG. 10 is a section view of a plurality of radiant heat barrier trays positioned end-to-end under a roof.
Figure 11:
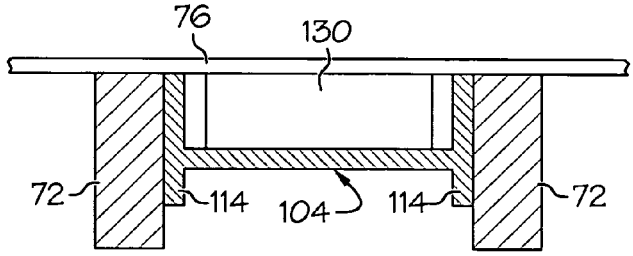
FIG. 11 is a section view taken along line 11-11 of FIG. 10.

The exemplary embodiment of board 102 configures body 106 to be less than 22½ inches wide for use with 2×4 rafters disposed on 24 inch centers. The width is designed to allow tabs 114 and 118 to be folded down 180 degrees from tray side 112 to fit against the side surfaces of rafters 72 as shown in FIG. 10. Board 102 may by four feet long. Boards 102 of these dimensions will readily fit into most attic and crawl spaces where the barrier is to be installed.

In order to use boards 102, one erects a sufficient quantity of trays 104 from boards 102 to mostly cover the inside of a roof—such as the roof of a dwelling. Trays 104 are installed between the rafters and may be installed up against the inner surface of the roof. FIG. 10 is a longitudinal section view taken through four trays 104 installed between rafters 72 (only one rafter 72 is shown) under a roof 76. Each tab 114 is disposed 180 degrees to side 112 and is secured to rafter 70 with an appropriate connector 152 such as an adhesive, a tape, or a mechanical connector (staple, tack, nail and the like). Trays 104 are disposed up against the inner surface of roof 76 to form air pockets. Trays 104 thus differ from the configuration of FIG. 3 wherein boards 70 define continuous air channels. The trapped air inside each tray 104 forms an insulating pocket. The high-reflectivity, low-emissivity surface of tray 104 reflects a substantial amount of radiant heat energy. In the summer, trays will reflect radiation back up through roof 76. In the winter, trays 104 will reflect radiation back toward the floor.

Trays 104 may be used in combination with channels 20 described above to provide a radiant energy barrier with two levels of protection. A further configuration of the invention combines trays 104, channels 20, and platforms 53 together.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An insulating tray used as a radiant energy barrier between roof supports; the tray comprising:

a body, a pair of longitudinal sides disposed substantially perpendicular to the body, and a pair of end walls disposed substantially perpendicular to the sides and the body;

the body having a high reflectivity, low emissivity adapted to reflect thermal radiation;

a primary connection tab associated with each of the sides; the primary connection tabs adapted to allow the tray to be mounted to the roof supports;

each primary connection tab being movable between first, second, and third positions with respect to the side; the primary connection tab being parallel with the body in the second position; and the primary connection tab being perpendicular to the body when the primary connection tab is in the first and third positions; and wherein each primary connection tab includes a score line that allows the primary connection tab to be folded; the score line being disposed parallel to the sides.

2. The tray of claim 1, wherein the primary connection tabs have crenulated edges.

3. The tray of claim 1, wherein the body has a pair of surfaces having a high reflectivity, low emissivity.

4. The tray of claim 1, further comprising corners integrally connected to the end walls; the corners disposed inwardly of the sides and substantially parallel to the sides; the corners connected to the sides.

5. The tray of claim 1, further comprising four secondary connection tabs; each side having two of the secondary connection tabs with a primary connection tab disposed between the two secondary connection tabs.

6. The tray of claim 5, wherein each side has three primary connection tabs.

7. An insulating tray used as a radiant energy barrier between roof supports; the tray comprising:

a body, a pair of longitudinal sides disposed substantially perpendicular to the body, and a pair of end walls disposed substantially perpendicular to the sides and the body;

the body having a high reflectivity, low emissivity adapted to reflect thermal radiation;

a primary connection tab associated with each of the sides; the primary connection tabs adapted to allow the tray to be mounted to the roof supports;

four secondary connection tabs; each side having two of the secondary connection tabs with a primary connection tab disposed between the two secondary connection tabs;

each primary connection tab being movable between first, second, and third positions with respect to the side; the primary connection tab being parallel with the body in the second position; and the primary connection tab being perpendicular to the body when the primary connection tab is in the first and third positions; and wherein the body and sides include a separation line disposed perpendicular to the sides; the separation line passing through the primary connection tab disposed between the two secondary connection tabs.

8. The tray of claim 7, wherein the body and sides include a pair of fold lines spaced from the separation line.

9. The tray of claim 7, wherein the sides and ends have the same height.

10. The tray of claim 7, wherein the primary connection tabs are formed from portions of the sides and connected to the sides with living hinges.

11. A radiant heat barrier board capable of being erected into an insulating tray; the board comprising:

a body having a length and a width; the length of the body defining the longitudinal direction of the body;

the body having a pair of longitudinal lines that define a pair of sides;

each of the sides having at least two primary connection tabs connected to the body with a living hinge;

the body having a pair of fold lines disposed perpendicular to the longitudinal lines to define a pair of end walls;

the body having at least one high reflectivity, low emissivity surface; and the body having a third line disposed between the longitudinal lines that define the pair of sides; the third line adapted to allow the user to reduce the width of the body by removing the side and portion of the body disposed outwardly of the third line.

12. The board of claim 11, wherein each of the sides defines three primary connection tabs.

13. The board of claim 12, wherein each side defines two secondary connection tabs; a primary connection tab being disposed between the two secondary connection tabs.

14. A radiant heat barrier board capable of being erected into an insulating tray; the board comprising:

a body having a length and a width; the length of the body defining the longitudinal direction of the body;

the body having a pair of longitudinal lines that define a pair of sides;

each of the sides having at least three primary connection tabs connected to the body with living hinges;

the body having a pair of fold lines disposed perpendicular to the longitudinal lines to define a pair of end walls;

the body having at least one high reflectivity, low emissivity surface;

each side defining two secondary connection tabs; a primary connection tab being disposed between the two secondary connection tabs; and wherein the body and sides include a separation line disposed perpendicular to the sides; the separation line passing through the primary connection tab disposed between the two secondary connection tabs.

15. The board of claim 14, wherein the tabs have crenulated edges.

* * * * *